US006377920B2

(12) United States Patent
Yeldener

(10) Patent No.: US 6,377,920 B2
(45) Date of Patent: Apr. 23, 2002

(54) METHOD OF DETERMINING THE VOICING PROBABILITY OF SPEECH SIGNALS

(75) Inventor: Suat Yeldener, Germantown, MD (US)

(73) Assignee: Comsat Corporation, Bethesda, MD (US)

( * ) Notice: Subject to any disclaimer, the term of this patent is extended or adjusted under 35 U.S.C. 154(b) by 0 days.

(21) Appl. No.: 09/794,150

(22) Filed: Feb. 28, 2001

Related U.S. Application Data

(63) Continuation of application No. 09/255,263, filed on Feb. 23, 1999, now Pat. No. 6,253,171.

(51) Int. Cl.[7] ..... G10L 11/06
(52) U.S. Cl. ..... 704/240; 704/208
(58) Field of Search ..... 704/208, 240

(56) References Cited

U.S. PATENT DOCUMENTS

| | | | | |
|---|---|---|---|---|
| 5,715,365 A | | 2/1998 | Griffin et al. | 704/214 |
| 5,774,837 A | * | 6/1998 | Yeldener et al. | 704/208 |
| 5,890,108 A | * | 3/1999 | Yeldener | 704/208 |
| 6,052,658 A | | 4/2000 | Wang et al. | 704/205 |

OTHER PUBLICATIONS

Daniel Wayne Griffin and Jae S. Lim, "Multiband Excitation Coder," IEEE Trans on Acoustics, Speech, and Signal Processing, vol. 36, No. 8, p. 1223–1235, Aug. 1988.

Suat Yeldener and Marion R. Baraniecki, "A Mixed Harmonic Excitation Linear Predictive Speech Coding For Low Bit Rate Applications," Proc. 32$^{nd}$ IEEE Asilomar Conference on Signals, Systems & Computers, vol. 1, p. 348–351, Nov. 1998.

* cited by examiner

*Primary Examiner*—Tālivaldis Ivars Šmits
(74) *Attorney, Agent, or Firm*—Sughrue Mion, PLLC

(57) ABSTRACT

A voicing probability determination method is provided for estimating a percentage of unvoiced and voiced energy for each harmonic within each of a plurality of bands of a speech signal spectrum. Initially, a synthetic speech spectrum is generated based on the assumption that speech is purely voiced. The original and synthetic speech spectra are then divided into plurality of bands. The synthetic and original speech spectra are compared harmonic by harmonic, and a voicing determination is made based on this comparison. In one embodiment, each harmonic of the original speech spectrum is assigned a voicing decision as either completely voiced or unvoiced by comparing the difference with an adaptive threshold. If the difference for each harmonic is less than the adaptive threshold, the corresponding harmonic is declared as voiced; otherwise the harmonic is declared as unvoiced. The voicing probability for each band is then computed based on the amount of energy in the voiced harmonics in that decision band. Alternatively, the voicing probability for each band is determined based on a signal to noise ratio for each of the bands which is determined based on the collective differences between the original and synthetic speech spectra within the band.

3 Claims, 3 Drawing Sheets

METHOD OF DETERMINING THE VOICING PROBABILITY OF SPEECH SIGNALS

This is a continuation of application Ser. No 09/255,263 filed Feb. 23, 1999, now U.S. Pat. No. 6,253,171, issued Jun. 26, 2001, the disclosure of which is incorporated herein by reference.

FIELD OF THE INVENTION

The present invention relates to a method of determining a voicing probability indicating a percentage of unvoiced and voiced energy in a speech signal. More particularly, the present invention relates to a method of determining a voicing probability for a number of bands of a speech spectrum of a speech signal for use in speech coding to improve speech quality over a variety of input conditions.

BACKGROUND OF THE INVENTION

Development of low bit rate (4.8 kb/s and below) speech coding methods with very high speech quality is currently a popular research subject. In order to achieve high quality speech compression, a robust voicing classification of speech signals is required.

An accurate representation of voiced or mixed type of speech signals is essential for synthesizing very high quality speech at low bit rates (4.8 kb/s and below). For bit rates of 4.8 kb/s and below, conventional Code Excited Linear Prediction (CELP) does not provide the appropriate degree of periodicity. A small code-book size and coarse quantization of gain factors at these rates result in large spectral fluctuations between the pitch harmonics. Alternative speech coding algorithms to CELP are the Harmonic type techniques. However, these techniques require robust pitch and voicing algorithms to produce a high quality speech.

Previously, the voicing information has been presented in a number of ways. In one approach, an entire frame of speech can be classified as either voiced or unvoiced. Although this type of voicing determination is very efficient, it results in a synthetic, unnatural speech quality.

Another voicing determination approach is based on the Multi-Band technique. In this technique, the speech spectrum is divided into various number of bands and a binary voicing decision (Voiced or Unvoiced) is made for each band. Although this type of voicing determination requires many bits to represent the voicing information, there can be voicing errors during classification, since the voicing determination method is an imperfect model which introduces some "buzziness" and artifacts in the synthesized speech. These errors are very noticeable, especially at low frequency bands.

A still further voicing determination method is based on a voicing cut-off frequency. In this case, the frequency components below the cut-off frequency are considered as voiced and above the cut-off frequency are considered as unvoiced. Although, this technique is more efficient than the conventional multi-band voicing concept, it is not able to produce voiced speech for high frequency components.

Accordingly, it is an object of the present invention to provide a voicing method that allows each frequency band to be composed of both voiced and unvoiced energy to improve output speech quality.

SUMMARY OF THE INVENTION

According to the present invention, a voicing probability determination method is provided for estimating a percentage of unvoiced and voiced energy for each harmonic within each of a plurality of bands of a speech signal spectrum.

Initially, a synthetic speech spectrum is generated based on the assumption that speech is purely voiced. The original speech spectrum and synthetic speech spectrum are then divided into plurality of bands. The synthetic and original speech spectra are then compared harmonic by harmonic, and each harmonic of the bands of the original speech spectrum is assigned a voicing decision as either completely voiced or unvoiced by comparing the error with an adaptive threshold. If the error for each harmonic is less than the adaptive threshold, the corresponding harmonic is declared as voiced; otherwise the harmonic is declared as unvoiced. The voicing probability for each band is then computed as the ratio between the number of voiced harmonics and the total number of harmonics within the corresponding decision band.

In another embodiment of the present invention, the signal to noise ratio for each of the bands is determined based on the original and synthetic speech spectra and the voicing probability for each band is determined based on the signal to noise ratio for the particular band.

BRIEF DESCRIPTION OF THE DRAWINGS

The present invention is described in detail below with reference to the enclosed figures, in which.

DETAILED DESCRIPTION OF THE INVENTION

In order to estimate the voicing of a segment of speech, the method of the present invention assumes that a pitch period (fundamental frequency) of an input speech signal is known. Initially, a speech spectrum $S_\omega(\omega)$ is obtained from a segment of an input speech signal using Fast Fourier Transformation (FFT) processing. Further, a synthetic speech spectrum is created based on the assumption that the segment of the input speech signal is fully voiced.

Figure 1:
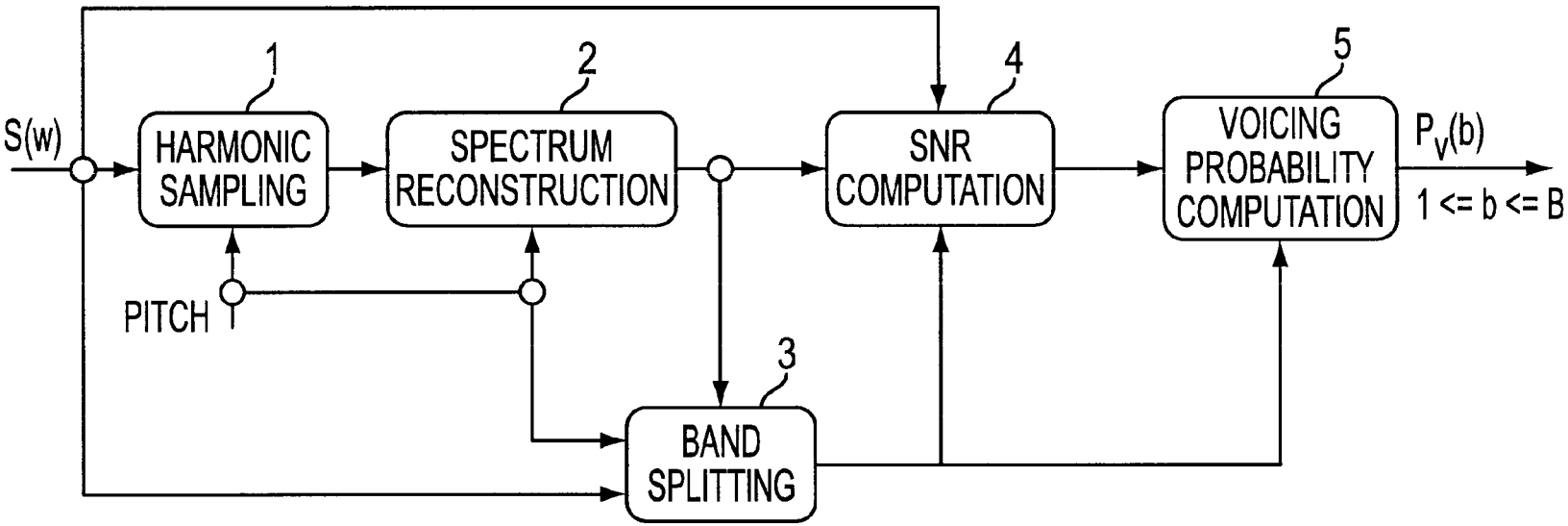
FIG. 1 is a block diagram of the voicing probability method in accordance with a first embodiment of the present invention.

FIG. 1 illustrates a first embodiment the voicing probability determination method of the present invention. The speech spectrum $S_\omega(\omega)$ is provided to a harmonic sampling section 1 wherein the speech spectrum $S_\omega(\omega)$ is sampled at harmonics of the fundamental frequency to obtain a magnitude of each harmonic. The harmonic magnitudes are provided to a spectrum reconstruction section 2 wherein a lobe (harmonic bandwidth) is generated for each harmonic and each harmonic lobe is normalized to have a peak amplitude which is equal to the corresponding harmonic magnitude of the harmonic, to generate a synthethic speech spectrum $\hat{S}\omega(\omega)$. The original speech spectrum $S_\omega(\omega)$ and the synthetic speech spectrum $\hat{S}\omega(\omega)$ are then divided into various numbers of decision bands B (e.g., typically 8 non-uniform frequency bands) by a band splitting section 3.

Next, the decision bands B of the original speech spectrum $S_\omega(\omega)$ and the synthetic speech spectrum $\hat{S}\omega(\omega)$ are provided to a signal to noise ratio (SNR) computation section 4 wherein a signal to noise ratio, $SNR_b$, for each band b of the total number of decision bands B is computed as follows:

$$SNR_b = \frac{\sum_{\omega \in W_b} |S_\omega(\omega)|^2}{\sum_{\omega \in W_b} \left(|S_\omega(\omega)| - |\hat{S}_\omega(\omega)|\right)^2}; 1 \le b \le B.$$

where $W_b$ is the frequency range of a bth decision band.

The signal to noise ratio $SNR_b$ for each decision band b is provided to a voicing probability computation section 5, wherein a voicing probability, Pv(b), for the bth band is then computed as:

$$P_v(b) = \begin{cases} 1.0 & SNR_b \ge 40 \\ \left(\frac{2}{75} SNR_b - \frac{1}{15}\right)^\beta & 2,5 < SNR_b < 40 \\ 0.0 & SNR_b \le 2.5 \end{cases}$$

where $0<\beta\leqq 1$ is a constant factor that can be set experimentally. Experimentation has shown that the typical optimal value of β is 0.5.

Figure 2:
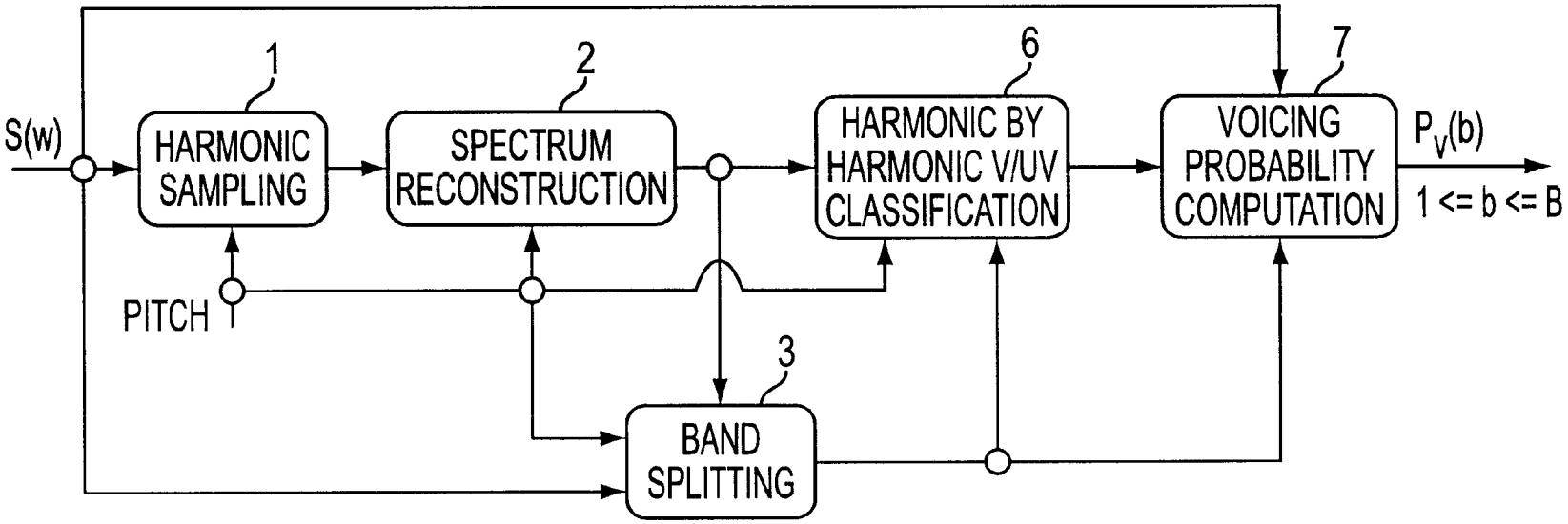
FIG. 2 is block diagram of the voicing probability method in accordance with a second embodiment of the present invention.

FIG. 2 is a block diagram illustrating a second embodiment of the voicing probability determination method of the present invention. As in FIG. 1, the synthetic speech spectrum $\hat{S}\omega(\omega)$ is generated by the harmonic sampling section 1 and the spectrum reconstruction section 2, and the original speech spectrum $S_\omega(\omega)$ and the synthetic speech spectrum $\hat{S}\omega(\omega)$ are divided into a plurality of decision bands B by a band splitting section 3. The original speech spectrum $S_\omega(\omega)$ and the synthetic speech spectrum $\hat{S}\omega(\omega)$ are then compared harmonic by harmonic for each decision band b by a harmonic classification section 6. If the difference between the original speech spectrum $S_\omega(\omega)$ and the synthetic speech spectrum $\hat{S}\omega(\omega)$ for the decision band b is less than the adaptive threshold, the corresponding harmonic is declared as voiced by the harmonic classification section 6, otherwise the harmonic is declared as unvoiced. In particular, each harmonic of the speech spectrum is determined to be either voiced, V(k)=1, or unvoiced, V(k)=0, (where k is the number of the harmonic and $1\leqq k\leqq L$), depending on the magnitude of the difference (error) between the original speech spectrum $S_\omega(\omega)$ and the synthetic speech spectrum $\hat{S}\omega(\omega)$ for the corresponding harmonic k. Here, L is the total number of harmonics within a 4 kHz speech band.

The voicing probability Pv(b) for each band b is then computed by a voicing probability section 7 as the energy ratio between voiced and all harmonics within the corresponding decision band:

$$P_v(b) = \sqrt{\frac{\sum_{k \in W_b} V(k)(A(k))^2}{\sum_{k \in W_b} (A(k))^2}}$$

where V(k) is the binary voicing decision and A(k) is spectral amplitude for the $k^{th}$ harmonic within $b^{th}$ decision band.

Figure 3A:
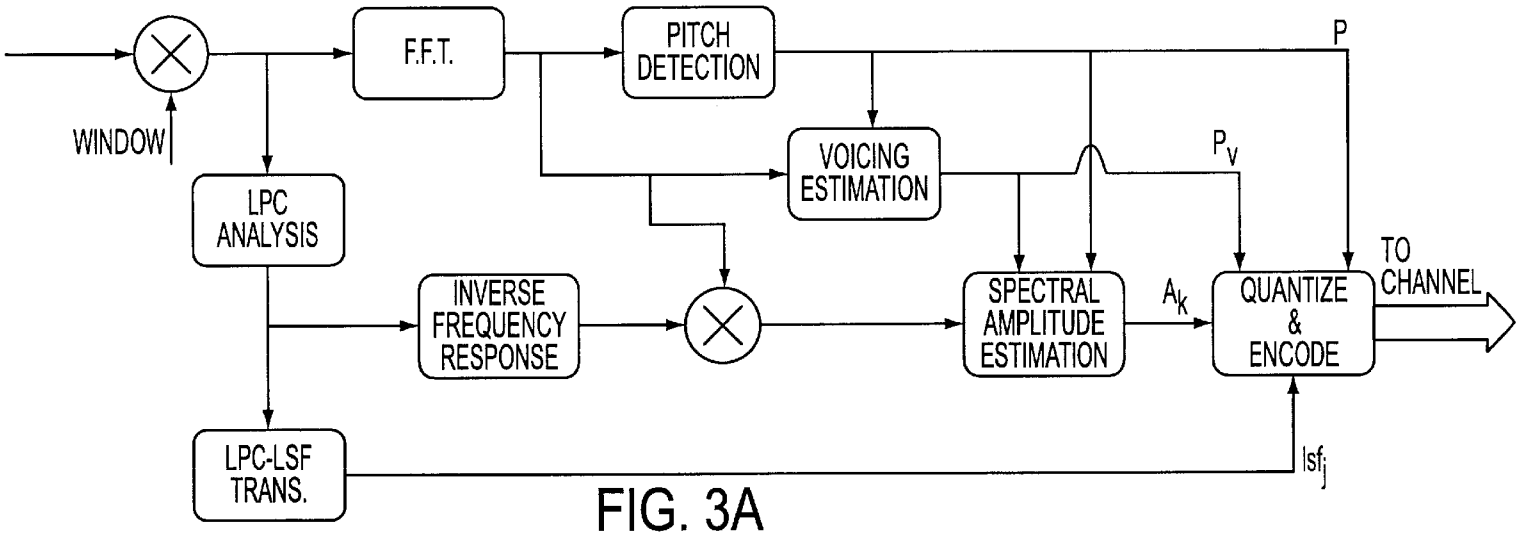
FIGS. 3A and 3B are block diagrams of a speech encoder and decoder, respectively, embodying the method of the present invention.
Figure 3B:
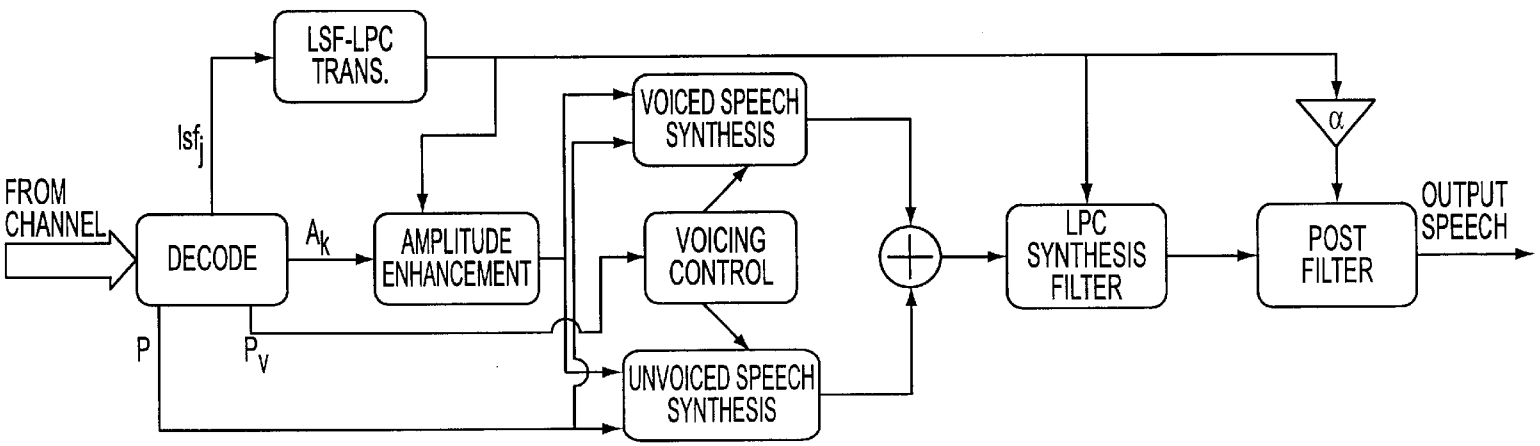

The above described method of voice probability determination may be utilized in a Harmonic Excited Linear Predictive Coder (HE-LPC) as shown in the block diagrams of FIGS. 3A and 3B. In the HE-LPC encoder (FIG. 3A), the approach to representing a input speech signal is to use a speech production model where speech is formed as the result of passing an excitation signal through a linear time varying LPC inverse filter, that models the resonant characteristics of the speech spectral envelope. The LPC inverse filter is represented by LPC coefficients which are quantized in the form of line spectral frequency (LSF). In the HE-LPC, the excitation signal is specified by the fundamental frequency, harmonic spectral amplitudes and voicing probabilities for various frequency bands.

At the decoder (FIG. 3B), the voiced part of the excitation spectrum is determined as the sum of harmonic sine waves which give proper voiced/unvoiced energy ratios based on the voicing probabilities for each frequency band. The harmonic phases of sine waves are predicted from the previous frame's information. For the unvoiced part of the excitation spectrum, a white random noise spectrum is normalized to unvoiced harmonic amplitudes to provide appropriate voiced/unvoiced energy ratios for each frequency band. The voiced and unvoiced excitation signals are then added together to form the overall synthesized excitation signal. The resultant excitation is then shaped by a linear time-varying LPC filter to form the final synthesized speech. In order to enhance the output speech quality and make it cleaner, a frequency domain post-filter is used.

Informal listening tests have indicated that the HE-LPC algorithm produces very high quality speech for variety of clean input and background noise conditions. Experimentation showed that major improvements were introduced by utilizing the voicing probability determination method of the present invention in the HE-LPC.

Although the present invention has been shown and described with respect to preferred embodiments, various changes and modifications within the scope of the invention will readily occur to those skilled in the art.

What is claimed is:

1. A method for determining a voicing probability of a speech signal comprising the steps of:

generating an original speech spectrum $S_\omega(\omega)$ of the speech signal, where ω is a frequency;

generating a synthetic speech spectrum $\hat{S}\omega(\omega)$ from the original speech spectrum $S_\omega(\omega)$ based on the assumption that the speech signal is purely voiced;

dividing the original speech spectrum $S_\omega(\omega)$ and the synthetic speech spectrum $\hat{S}\omega(\omega)$ into a plurality of bands B each containing a plurality of frequencies ω;

comparing said original and synthetic speech spectra within each band; and determining a voicing probability for each band on the basis of said comparison, wherein said voicing probability is an energy ratio between a total number of voiced harmonics within each band and a total number of harmonics within each band.

2. A method according to claim 1, where ω represents a harmonic of a fundamental frequency of said speech signal, and said comparing step comprises comparing the original speech spectrum and the synthetic speech spectrum for each harmonic of each band b of the plurality of bands B to determine a difference between the original speech spectrum and the synthetic speech spectrum for each harmonic of each band b of the plurality of decision bands B; and said determining step comprises:

determining whether each harmonic of the original speech spectrum is voiced, V(k)=1, or unvoiced, V(k)=0, based on the difference between the original speech spectrum and the synthetic speech spectrum for each harmonic k, wherein V(k) is a binary voicing determination, $1<k\leqq L$, and L is the total number of harmonics within a 4 kHz speech band; and determining a voicing probability Pv(b) for each band b, wherein $$P_v(b) = \sqrt{\frac{\sum_{k \in W_b} V(k)(A(k))^2}{\sum_{k \in W_b} (A(k))^2}}$$

where A(k) is a spectral amplitude for the $k^{th}$ harmonic in $b^{th}$ band.

3. A method for determining a voicing probability of a speech signal according to claim 2, wherein said step of generating an synthetic speech spectrum comprises the steps of:

sampling the original speech spectrum at harmonics of a fundamental frequency of said speech signal to obtain a harmonic magnitude of each harmonic;

generating a harmonic lobe for each harmonic based on the harmonic magnitude of each harmonic; and normalizing the harmonic lobe for each harmonic to have a peak amplitude which is equal to the harmonic magnitude of each harmonic to generate the synthethic speech spectrum.

* * * * *